US011404181B2

(12) United States Patent
Kuroda et al.

(10) Patent No.: US 11,404,181 B2
(45) Date of Patent: Aug. 2, 2022

(54) COPPER ALLOY WIRE, PLATED WIRE, ELECTRICAL WIRE AND CABLE

(71) Applicant: Hitachi Metals, Ltd., Tokyo (JP)

(72) Inventors: Hiromitsu Kuroda, Tokyo (JP); Takashi Hayasaka, Tokyo (JP); Detian Huang, Tokyo (JP); Ryohei Okada, Tokyo (JP); Tamotsu Sakurai, Tokyo (JP)

(73) Assignee: Hitachi Metals, Ltd., Tokyo (JP)

( * ) Notice: Subject to any disclaimer, the term of this patent is extended or adjusted under 35 U.S.C. 154(b) by 0 days.

(21) Appl. No.: 17/163,697

(22) Filed: Feb. 1, 2021

(65) Prior Publication Data

US 2021/0249149 A1 Aug. 12, 2021

(30) Foreign Application Priority Data

Feb. 6, 2020 (JP) ..... JP2020-018774
Dec. 11, 2020 (JP) ..... JP2020-205438

(51) Int. Cl.
*H01B 7/02* (2006.01)
*H01B 1/02* (2006.01)

(52) U.S. Cl.
CPC ..... *H01B 1/026* (2013.01)

(58) Field of Classification Search
CPC ..... H01B 1/026; H01B 7/02; H01B 7/0036; H01B 4/185; H01B 5/00; H01B 13/0016; C22F 1/08
USPC ..... 174/102 R, 108, 109, 110 R, 113 R
See application file for complete search history.

(56) References Cited

U.S. PATENT DOCUMENTS

| | | | | |
|---|---|---|---|---|
| 6,518,505 | B1 * | 2/2003 | Matsui | H01B 1/026 174/126.1 |
| 6,627,009 | B1 * | 9/2003 | Matsui | C22C 9/00 148/433 |
| 2002/0066503 | A1 * | 6/2002 | Matsui | C22F 1/08 148/432 |
| 2007/0187134 | A1 * | 8/2007 | Detian | H01B 5/08 174/126.1 |
| 2012/0018192 | A1 * | 1/2012 | Takahashi | C22F 1/00 174/128.1 |
| 2016/0284437 | A1 * | 9/2016 | Inoue | H01B 7/0036 |

FOREIGN PATENT DOCUMENTS

| | | | |
|---|---|---|---|
| JP | H05311285 | A | 11/1993 |
| JP | 2014159609 | A | 9/2014 |
| JP | 2015004118 | A | 1/2015 |
| WO | 2014007259 | A1 | 1/2014 |

* cited by examiner

*Primary Examiner* — William H. Mayo, III
(74) *Attorney, Agent, or Firm* — McCormick, Paulding & Huber PLLC

(57) ABSTRACT

A copper alloy wire is made of a copper alloy, and the copper alloy contains indium, a content of which is equal to or more than 0.3 mass % and equal to or less than 0.45 mass %. A tensile strength of the copper alloy wire is equal to or higher than 800 MPa, and an electrical conductivity of the same is equal to or higher than 80% IACS.

8 Claims, 3 Drawing Sheets

COPPER ALLOY WIRE, PLATED WIRE, ELECTRICAL WIRE AND CABLE

CROSS-REFERENCE TO RELATED APPLICATION

The present application claims priority from Japanese Patent Application No. 2020-018774 filed on Feb. 6, 2020, and Japanese Patent Application No. 2020-205438 filed on Dec. 11, 2020, the content of which is hereby incorporated by reference into this application.

TECHNICAL FIELD OF THE INVENTION

The present invention relates to a copper alloy wire and a plated wire, and an electrical wire and a cable using the copper alloy wire or the plated wire.

A Patent Document 1 (Japanese Patent Application Laid-Open Publication No. H05-311285) describes a copper alloy wire containing not only Cu but also In and Sn. A Patent Document 2 (Japanese Patent Application Laid-Open Publication No. 2014-159609) describes a copper alloy body containing at least one type of an element selected from a group consisting of Ag, In, Mg and Sn, a content of which is equal to or more than 0.01 atomic %, as a copper alloy body obtained before wire drawing. A Patent Document 3 (International Patent Publication No. WO/2014/007259) describes that an intermediate heating process is performed between a plurality of cooling processes in steps of manufacturing a copper alloy member. A Patent Document 4 (Japanese Patent Application Laid-Open Publication No. 2015-4118) describes that an annealing process, and then, a finish drawing process are performed after a drawing process in manufacturing steps of a drawn copper wire.

SUMMARY OF THE INVENTION

A metallic wire made of a copper alloy is intended for various purposes. For example, there is a demand for thinning of a metallic wire configuring a conductor or a cable that is used for a wiring component of an electronic device. In such a purpose in use, it is necessary to improve a strength and improve an electrical conductivity of the thinned metallic wire.

An objective of the present invention is to provide a technique capable of achieving both the improvement of the strength and the improvement of the electrical conductivity of the metallic wire.

A copper alloy wire according to one embodiment is a copper alloy wire made of a copper alloy, and the copper alloy contains indium, a content of which is equal to or more than 0.3 mass % and equal to or less than 0.45 mass %. A tensile strength of the copper alloy wire is equal to or higher than 800 MPa, and an electrical conductivity of the same is equal to or higher than 80% IACS.

For example, the copper alloy contains tin, a content of which is equal to or more than 0.02 mass % and less than 0.1 mass %, and a total content of the indium and the tin is equal to or less than 0.45 mass %.

An electrical wire according to another embodiment includes a conductor made of a copper alloy wire, and a coating insulator on a periphery of the conductor. The copper alloy wire is made of a copper alloy containing indium, a content of which is equal to or more than 0.3 mass % and equal to or less than 0.45 mass %. A tensile strength of the copper alloy wire is equal to or higher than 800 MPa, and an electrical conductivity of the copper alloy wire is equal to or higher than 80% IACS.

For example, the copper alloy of the electrical wire contains tin, a content of which is equal to or more than 0.02 mass % and less than 0.1 mass %, and a total content of the indium and the tin is equal to or less than 0.45 mass %.

For example, the conductor is made of a strand wire of a plurality of the copper alloy wires.

A plated wire according to another embodiment includes a copper alloy wire, and a plating layer that is arranged on a periphery of the copper alloy wire, and the copper alloy wire is made of a copper alloy containing indium, a content of which is equal to or more than 0.3 mass % and equal to or less than 0.45 mass %, a tensile strength of the copper alloy wire is equal to or higher than 750 MPa, an electrical conductivity of the same is equal to or higher than 78% IACS, and elongation of the same is equal to or lower than 3%.

A cable according to another embodiment includes a conductor made of a copper alloy wire, a plurality of core wires having a coating insulator on a periphery of the conductor, and a collectively-coating sheath on a periphery of the plurality of core wires. The copper alloy wire is made of a copper alloy containing indium, a content of which is equal to or more than 0.3 mass % and equal to or less than 0.45 mass %. A tensile strength of the copper alloy wire is equal to or higher than 800 MPa, and an electrical conductivity of the copper alloy wire is equal to or higher than 80% IACS.

For example, the copper alloy of the cable contains tin, a content of which is equal to or more than 0.02 mass % and less than 0.1 mass %, and a total content of the indium and the tin is equal to or less than 0.45 mass %.

According to a typical embodiment of the present invention, both the improvement of the strength and the improvement of the electrical conductivity of the metallic wire can be achieved.

BRIEF DESCRIPTIONS OF THE DRAWINGS

DESCRIPTIONS OF THE PREFERRED EMBODIMENTS

Hereinafter, embodiments of the present invention will be explained with reference to the drawings. In the following explanation, a metallic wire that is made of a copper alloy having a wire diameter (outer diameter) that is equal to or smaller than 100 μm is referred to as copper alloy wire. And, a wire obtained before a drawing process to the copper alloy wire is referred to as a wire rod. A wire having a plating layer on a periphery of the copper alloy wire is referred to as plated wire.

In the following explanation, an indicator of "IACS (International Annealed Copper Standard)" is used as an evaluation indicator for the electrical conductivity. In the electrical conductivity using the IACS, an electrical conductivity of an annealed standard soft copper (having a volume resistivity: $1.724\times10^{-2}$ μΩm) is defined to be 100%

IACS, and a ratio with respect to the electrical conductivity of this annealed standard soft copper is described as "XX % IACS". The electrical conductivity that will be explained below is calculated on the basis of a result of measurement for an electrical resistance and a diameter of a test piece in accordance with a method of testing a copper wire for use in electricity, defined under the Japanese Industrial Standards (JIS C 3002: 1992).

In the following explanation, when the "tensile strength" and the "elongation" of the metallic wire are explained, the "tensile strength" and the "elongation" are defined as values that are calculated from a result of measurement of a tensile test for a test piece in accordance with the method of testing the copper wire for use in electricity, defined under the Japanese Industrial Standards (JIS C 3002: 1992).

<Structure of Metallic Wire>

Figure 1:
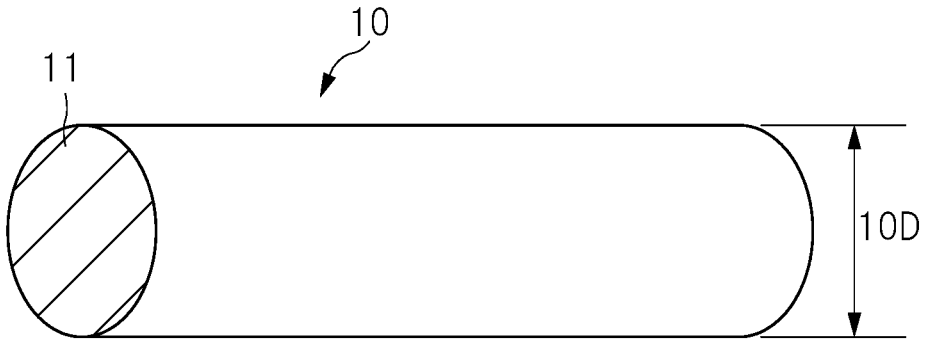
FIG. 1 is a perspective cross-sectional view of a metallic wire according to one embodiment.

FIG. 1 shows a perspective cross-sectional view of the metallic wire of the present embodiment. A copper alloy wire 10 shown in FIG. 1 is a copper alloy wire that is made of a copper alloy 11. The copper alloy 11 contains indium (In), a content of which is equal to or more than 0.3 mass % and equal to or less than 0.45 mass %. The copper alloy 11 contains unavoidable impurities as its remainder. The tensile strength of the copper alloy wire 10 is equal to or higher than 800 MPa (more preferably equal to or higher than 800 MPa and equal to or lower than 900 MPa), and the electrical conductivity of the copper alloy wire 10 is equal to or higher than 80% IACS (more preferably, equal to or higher than 80% IACS and equal to or lower than 85% IACS).

As the unavoidable impurities contained in the copper alloy 11, for example, aluminum (Al), silicon (Si), phosphorous (P), sulfur (S), chromium (Cr), iron (Fe), nickel (Ni), arsenic (As), selenium (Se), silver (Ag), antimony (Sb), lead (Pb), bismuth (Bi) and others are exemplified. The unavoidable impurities of the copper alloy 11 are contained in a range that is, for example, equal to or more than 20 mass ppm and equal to or less than 30 mass ppm.

In the copper alloy wire 10 including the copper alloy 11, both the high tensile strength and the high electrical conductivity can be achieved. Although more details will be described later in working example, the findings of the inventors of the present application are that the copper alloy wire 10 including the copper alloy 11 has the electrical conductivity that is equal to or higher than 80% IACS, the copper alloy containing the indium (In), a content of which is equal to or more than 0.3 mass % and equal to or less than 0.45 mass %, and containing the copper (Cu) and the unavoidable impurities as its remainders. The tensile strength of the copper alloy wire 10 was equal to or higher than 872 MPa. A value of the tensile strength of the copper alloy wire 10 varies depending on manufacturing conditions. However, even in consideration of the variation depending on manufacturing conditions, at least a value that is equal to or higher than 800 MPa can be obtained.

A conductive wire (simply referred to as electrical wire) transmitting electricity is a member configuring a transmission path for electrical power or a transmission path for an electrical signal, and is widely utilized in various fields. As a conductor in the electrical wire, a conductive material such as various-type pure metals, alloys or composite materials is used. In the present embodiment, as the conductor in the electrical wire, the copper alloy wire 10 made of the copper alloy 11 having the high electrical conductivity will be exemplified and explained.

The copper wire that is used as the conductor in the electrical wire is utilized in various field as described above. Meanwhile, a copper wire having a small wire diameter is demanded depending on the utilization field. For example, in an electronic device such as a mobile terminal, the electrical wire including the conductor made of the copper wire is used as an internal wiring component. In this case, a size that is equal to or smaller than 100 μm is often demanded in the wire diameter of the single copper wire. Alternatively, in a case of a probe cable utilized in a medical field, the probe cable is often intended to be inserted into a patient's body, and therefore, a copper wire having a smaller wire diameter is demanded. In the present embodiment, a copper alloy wire 10 having a diameter "10D" of 80 μm will be exemplified as one example of an extremely-thin wire for the explanation.

The tensile strength of the copper alloy wire 10 made of the copper alloy 11 can be improved when the copper alloy 11 is strained. As a method for generating the strain on the copper alloy 11, there are a method of increasing a content of a metallic element other than the copper contained in the copper alloy 11 and a method of performing a drawing process or others. However, when the copper alloy wire 10 is strained by such a method, a resistivity of the copper alloy 11 functioning as the conductive member increases, and therefore, the electrical conductivity of the copper alloy wire 10 decreases. That is, trade off exists between the increase in the tensile strength of the copper alloy wire 10 and the increase in the electrical conductivity of the copper alloy wire 10.

Accordingly, in order to find a configuration for improving properties of an electrical conductivity and a tensile strength of a solid-solution-hardening copper alloy 11, the inventors of the present application have paid attention to influence of solid-solution of plural-type metal elements into the copper alloy 11 on the decrease in the electrical conductivity of the copper alloy 11, and attention to a degree of contribution of the solid-solution to the increase in the tensile strength. That is, the degree of the contribution to the increase in the tensile strength of the copper alloy wire 10 varies depending on the type of the metallic element, and a large content of the element that is solid-solved into the copper proportionally increases the tensile strength. The tin (Sn) and the indium (In) have larger influence on the increase in the tensile strength than those of metals such as aluminum (Al), nickel (Ni), magnesium (Mg) and others when being solid-solved into the copper, and therefore, are effective additive metals.

On the other hand, the degree of the influence on the decrease in the electrical conductivity significantly varies depending on the type of the metallic element. More specifically, the decrease in the electrical conductivity in the case of the silver (Ag), the indium (In) or the magnesium (Mg) can be suppressed more than that in the case of the metal such as the nickel (Ni), the tin (Sn) the aluminum (Al) or others even when its solid-solved concentration in the copper is large. For example, when a concentration (mass concentration) of the solid-solved metal element in oxygen-free copper is 900 ppm, in an assumption that an electrical conductivity of pure copper is 100% (percentage), the electrical conductivity in the case of the indium (In) merely decreases down to about 98% while the electrical conductivity in the case of the tin (Sn) decreases down to about 92%. The electrical conductivity in the case of the silver (Ag) merely decreases down to about 99% in the assumption that the electrical conductivity of pure copper is 100% (percentage).

Because of the above-described properties, the copper alloy 11 that is obtained by the solid solution of the indium in the copper has high properties of the electrical conductivity and tensile strength. A case of a copper alloy that is obtained by the solid solution of the silver (Ag) in the copper provides a higher electrical conductivity than that of the copper alloy wire 10 of the present embodiment can be obtained. However, when concentrations of these materials are the same as each other, the silver has smaller effect on the increase in the tensile strength than that of the indium. Therefore, the increase in the content of the silver increases a raw material cost of the copper alloy wire 10, and thus, the solid solution of the indium is preferable.

In order to improve the tensile strength of the copper alloy 11, a content of oxygen in the copper alloy is preferably small. In the case of the present embodiment, the oxygen contained in the copper alloy 11 is equal to or less than 0.002 mass %. When the oxygen contained in the copper alloy 11 is equal to or less than 0.002 mass %, the decrease in the tensile strength of the copper alloy 11 due to the oxygen can be suppressed.

As a modification example of the copper alloy wire 10 shown in FIG. 1, the copper alloy 11 contains the indium (In), a content of which is equal to or more than 0.3 mass % and less than 0.43 mass %, contains the tin (Sn), a content of which is equal to or more than 0.02 mass % and less than 0.1 mass %, and contains a remainder made of copper (Cu) and unavoidable impurities. Note that a total content of the indium and the tin in the copper alloy 11 is equal to or less than 0.45 mass %.

The case of the modification example of the copper alloy wire 10 contains the tin into which the copper alloy 11 is solid-solved, and therefore, has a lower electrical conductivity than that of the copper alloy wire 10 not containing the tin. However, when the content of the tin is less than 0.1 mass % and when the content of the indium is equal to or more than 0.3 mass %, the electrical conductivity that is equal to or higher than 80% IACS can be maintained. Note that a total content of the indium and the tin in the copper alloy 11 is desirable to be equal to or less than 0.45 mass %. The findings from the following experiments are that the tensile strength of the modification example of the copper alloy wire 10 was equal to or higher than 872 MPa as long as the experiment was made within a range of the above-described conditions. As seen from this, in the case of the modification example of the copper alloy wire 10, by the solid solution of the tin, the electrical conductivity that is equal to or higher than 80% IACS can be maintained while the raw material cost of the copper alloy wire 10 can be reduced.

<Method for Manufacturing Metallic Wire>

Figure 2:
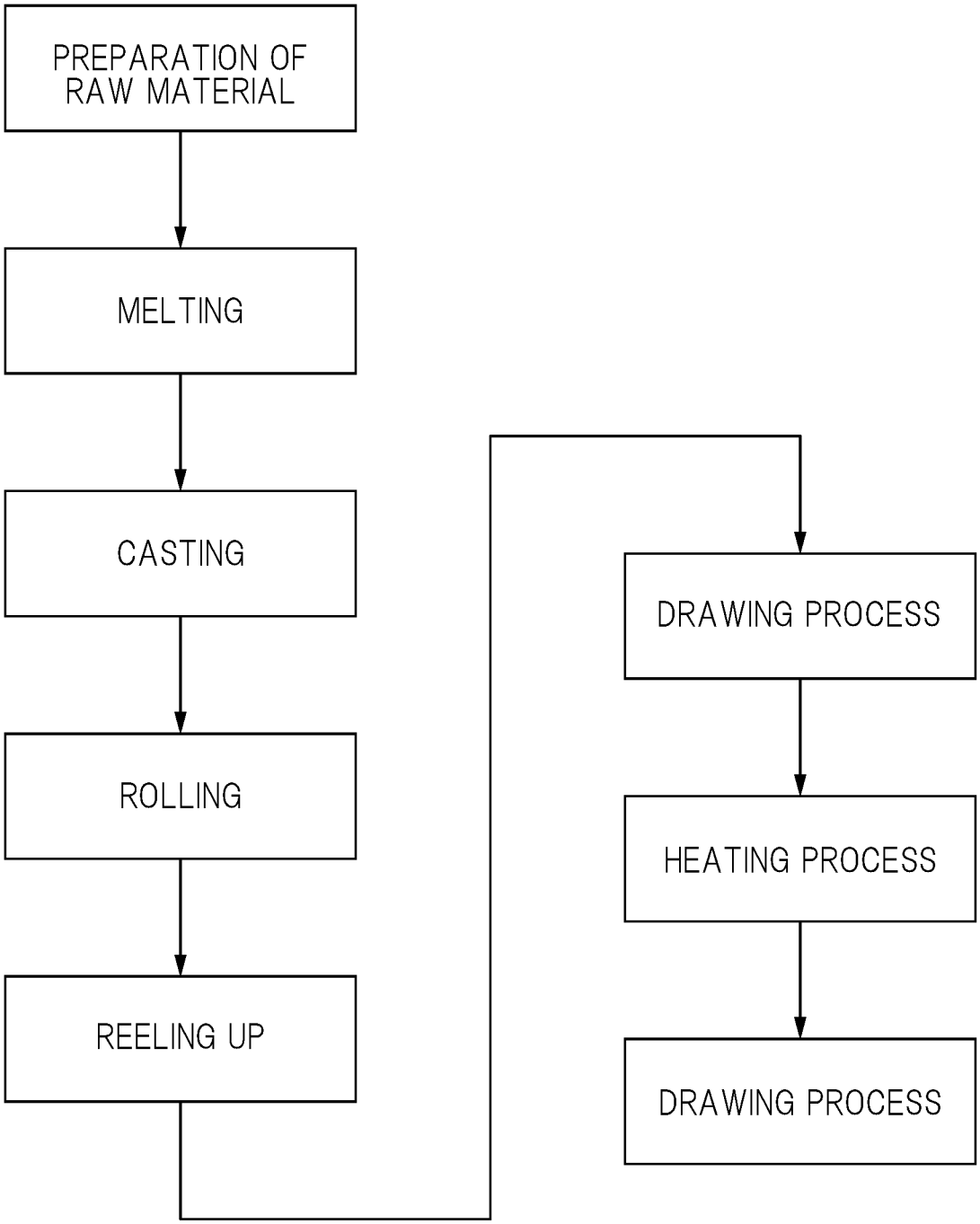
FIG. 2 is a flowchart showing one example of steps of manufacturing the metallic wire shown in FIG. 1.

Next, a method for a manufacturing the copper alloy wire 10 shown in FIG. 1 will be explained. Although the above-described copper alloy wire 10 includes a case with the containing of the tin in the copper alloy and a case without the containing of the same therein, the manufacturing methods in the cases are the same as each other. FIG. 2 is a flowchart showing one example of steps for manufacturing the metallic wire shown in FIG. 1.

Hereinafter, as the method for manufacturing the metallic wire, a method for manufacturing the metallic wire will be exemplified for the explanation, the method manufacturing a wire rod having a wire diameter of a certain thickness (for example, about 8 to 12 mm) by a continuous casting/rolling method, and then, performing a drawing process to the wire rod. As the continuous casting/rolling method, for example, a continuous casting/rolling method that is so-called SCR (Southwire Continuous Rod) system can be used.

First, as a raw-material preparation step shown in FIG. 2, a raw material is prepared. The raw material is a metal containing copper as a main component. The raw material contains not only the copper but also an unavoidably-mixed impurity element in some cases. And, an additive element including the indium is contained in the raw material. In the method for manufacturing the metallic wire explained as the modification example of the copper alloy wire 10 shown in FIG. 1, the additive element is the indium and the tin. These additive elements are added to the raw material containing the copper as the main component within a range that meets the above-described conditions of the content.

Next, as a melting step shown in FIG. 2, the raw material is melted inside a melting furnace not illustrated. The melting furnace is a heating furnace capable of continuously melting the raw material, and the molten copper that is melted in the melting furnace sequentially moves to a holding furnace not illustrated.

Next, as a casting step shown in FIG. 2, the molten copper in the holding furnace is cast into a mold not illustrated, and then, is cooled, and thus, is solidified. The solidified casting is detached from the mold, and is continuously fed to a rolling mill. The melting step to the casting step shown in FIG. 2 are performed in inert gas atmosphere (such as nitrogen atmosphere). Oxygen hardly exists in the inert gas atmosphere, and its oxygen concentration (volumetric concentration) is at least equal to or lower than 10 ppm. When the wire rod is manufactured in the inert gas atmosphere having the extremely low oxygen concentration as described above, the containing of the oxygen in the copper during the casting step can be suppressed.

Next, as a rolling step shown in FIG. 2, the casting is rolled and milled to form a wire rod having a wire diameter of about 8 to 12 mm. In the rolling step, a rolling process is separately performed a plurality of times in some cases. When the casting being obtained in the casting step is used as the wire rod so as to remain unchanged, note that this rolling step can be omitted.

Next, as a reeling-up step shown in FIG. 2, the casting is reeled up by a reeling-up apparatus not illustrated, so that the wire rod is obtained. Note that the wire rod that is reeled up by the reeling-up apparatus has a tensile strength that is about equal to or higher than 250 MPa and equal to or lower than 300 MPa and has an electrical conductivity that is about higher than 85% IACS and equal to or lower than 90% IACS.

Next, as a drawing-process step shown in FIG. 2, the wire rod is milled until its wire diameter becomes equal to or less than 100 μm (for example, about 50 to 80 μm), so that the copper alloy wire 10 shown in FIG. 1 is obtained. In the drawing-process step, so-called cold drawing process at a room temperature (such as 25° C.) is performed. The wire rod is elongated in an extension direction in the drawing-process step. The drawing process is divided into a plurality of drawing-process steps (the first drawing-process step and the second drawing-process step), and a heating process is performed as a heating-process step (referred to as annealing step in some cases) between the drawing-process steps, to a drawn wire member in the drawing process. In the first drawing-process step, note that the rod wire (having a wire diameter that is, for example, 8 mm to 12 mm) may be drawn by one drawing-process step to have a desirable wire diameter (that is, for example, equal to more than 0.5 mm and equal to or less than 3.0 mm). Such a drawing-process step provides the electrical conductivity, the tensile strength and the elongation of the metallic wire after the heating-process step so that these properties are in a desirable range, and is effective to provide the copper alloy wire 10 obtained through the second drawing-process step, the copper alloy wire having the electrical conductivity that is equal to higher than 80% IACS and the tensile strength that is equal to or higher than 800 MPa.

When the metallic wire is strained during the drawing process, the tensile strength of the metallic wire can be increased. However, the electrical conductivity of the metallic wire is decreased. The heating process (also referred to as the annealing process in some cases) in the middle of the drawing process decreases the strain of the metallic wire. Therefore, although the tensile strength of the heat-processed metallic wire decreases, the electrical conductivity of the same increases. From the studies of the present inventors, it has been found that the high tensile strength and the high electrical conductivity of the hard metallic wire (copper alloy wire 10) as a final product can be maintained when the heating-process step in the middle of the drawing step (between the first drawing-process step and the second drawing-process step) is performed so as to meet the following conditions. Note that the hard copper alloy wire described in the specification is a metallic wire having elongation that is equal to or higher than 0.5% and equal to or lower than 3%.

When "C=B/A" is set in an assumption that the tensile strength of the metallic wire obtained before the heating process (that is after the drawing-process step but immediately before the heating process) is represented by "A" and the tensile strength of the metallic wire obtained after the heating process (that is immediately after the heating process) is represented by "B", the heating process is performed so that a value of the tensile-strength ratio "C" is equal to or higher than 0.5 and equal to or lower than 0.8. When "F=E/D" is set in an assumption that the elongation of the metallic wire obtained before the heating process (that is after the drawing-process step but immediately before the heating process) is represented by "D" and the elongation of the metallic wire obtained after the heating process (that is immediately after the heating process) is represented by "E", the heating process is performed so that a value of the elongation ratio "F" is equal to or higher than 10 and equal to or lower than 50. As shown in FIG. 2, since the drawing process is further performed after the heating-process step, it is preferable to perform the heating process in the heating-process step so that the electrical conductivity of the metallic wire obtained immediately after the heating-process step is equal to or higher than 86% IACS (more preferably equal to or higher than 88% IACS). The tensile strength of the metallic wire obtained immediately after the heating-process step is preferably equal to or higher than 200 MPa and equal to or lower than 300 MPa, and the elongation of the metallic wire obtained immediately after the heating-process step is preferably equal to or higher than 20% and equal to or lower than 40%. In this manner, the electrical conductivity obtained after the drawing-process step (the second drawing-process step) following the heating-process step can be equal to or higher than 80% IACS. In the heating-process step, note that the heating process may be performed at a temperature that is, for example, equal to or higher than 400° C. and equal to or lower than 900° C.

In FIG. 2, note that the aspect has been explained, the aspect drawing the wire rod to have the desirable wire diameter (being, for example, equal to or larger than 0.5 mm and equal to or smaller than 3.0 mm) by the drawing-process step (the first drawing-process step), followed by the heating-process step of heating the metallic wire under the above-described conditions, and followed by the drawing to have the desirable wire diameter (being, for example, equal to or smaller than 0.1 mm) by the drawing-process step (the second drawing-process step). However, various modification examples are applicable. For example, the second drawing-process step may be divided into a plurality of drawing-process steps, and the metallic wire may be gradually drawn to have the desirable wire diameter by each step of the plurality of drawing-process steps. The gradual drawing of the metallic wire through the plurality of drawing-process steps in the second drawing-process step can more stably provide the hard metallic wire (the coper alloy wire 10) than that of the case of the second drawing-process step made of the single drawing-process step. When the second drawing-process step is made of the plurality of drawing-process steps, note that the heating-process step may be arranged between the plurality of drawing-process steps if needed.

<Alloy Composition and Property Evaluation>

Next, experimental results of relation between a composition of the alloy contained in the copper alloy wire 10 shown in FIG. 1 and properties will be explained. A table 1 is a table showing the relation between the composition of the alloy contained in the metallic wire and the properties.

TABLE 1

| Specimen | Alloy Composition (mass %) | | Properties | | |
|---|---|---|---|---|---|
| | | | Tensile strength | Electrical conductivity | Elongation |
| No. | Sn | In | (MPa) | (% IACS) | (%) |
| 1 | 0.05 | 0.30 | 860 | 83 | 2.8 |
| 2 | 0.05 | 0.35 | 875 | 82 | 2.5 |
| 3 | 0 | 0.40 | 872 | 84 | 2.5 |
| 4 | 0 | 0.45 | 877 | 82 | 2.7 |
| 5 | 0.02 | 0.38 | 874 | 83 | 2.8 |
| 6 | 0.05 | 0.32 | 872 | 82 | 2.8 |
| 7 | 0.05 | 0.40 | 881 | 80 | 2.4 |
| 8 | 0.19 | 0.20 | 850 | 74 | 2.4 |
| 9 | 0.19 | 0.50 | 967 | 75 | 2.5 |
| 10 | 0 | 0.50 | 905 | 79 | 2.5 |
| 11 | 0.05 | 0.20 | 785 | 86 | 2.8 |
| 12 | 0.10 | 0.20 | 790 | 82 | 2.7 |
| 13 | 0.05 | 0.50 | 910 | 77 | 2.8 |
| 14 | 0.10 | 0.50 | 936 | 73 | 2.6 |

In the table 1, the specimens No. 1 to 7 represent working examples that meet the conditions of the copper alloy wire 10, and the specimens No. 8 to 14 represent comparative examples that do not meet the conditions of the copper alloy wire 10. Each of the specimens No. 1 to 14 was manufactured by the manufacturing method explained with reference to FIG. 2. In the table 1, a specimen used in the tensile strength test and the elongation test is a metallic wire that was processed to have a diameter of about 80 μm. Each of the copper alloy wire used for the specimens No. 1 to 14 was made of the copper alloy containing the indium (In) and the tin (Sn), a content of each of which is shown in the table 1, and containing the remainder made of the copper (Cu) and the unavoidable impurities. A tensile speed was set to 20 mm/min., and a gauge length in measurement of the elongation was set to 100 mm. The tensile strength is expressed by a value that is obtained by dividing a maximum load value at fracture by a cross-sectional area of each specimen. The cross-sectional area of each specimen is calculated as an area of an exact circle based on a wire diameter that is measured down to 1/1000 mm in a micrometer. A value of the elongation is expressed by a percentage of total elongation at fracture (a sum of elastic elongation and plastic elongation in the extensometer) with respect to a gauge length of an extensometer. Although omitted in the table 1, each of the specimens No. 1 to 14 was prepared under environment in which oxygen is difficult to be contained, and oxygen contained in the copper alloy of each specimen was equal to or lower than 0.002 mass %.

As seen from a result of comparison among the specimens No. 1, 5, 6, 8, 11 and 12 in the table 1, when the content of the indium is equal to or more than 0.30 mass %, the tensile strength of the specimen can be equal to or higher than 800 MPa, and the electrical conductivity of the same can be equal to or higher than 80% IACS. Also, as seen from a result of comparison among the specimens No. 3, 4 and 10 therein, in a case without addition of the tin as the additive element, when the content of the indium is equal to or less than 0.45 mass %, the tensile strength of the specimen can be equal to or higher than 800 MPa, and the electrical conductivity of the same can be equal to or higher than 80% IACS.

Further, as seen from a result of comparison among the specimens No. 5, 8, 9 and 14 in the table 1, in a case with addition of the indium and the tin to the copper alloy, when the content of the tin is equal to or more than 0.02 mass % and less than 0.1 mass %, the tensile strength of the specimen can be equal to or higher than 800 MPa, and the electrical conductivity of the same can be equal to or higher than 80% IACS. However, as seen from a result of comparison between the specimens No. 7 and 13 therein, the total content of the indium and the tin is preferably equal to or less than 0.45 mass %.

<Application Example of Copper Alloy Wire>

Figure 3:
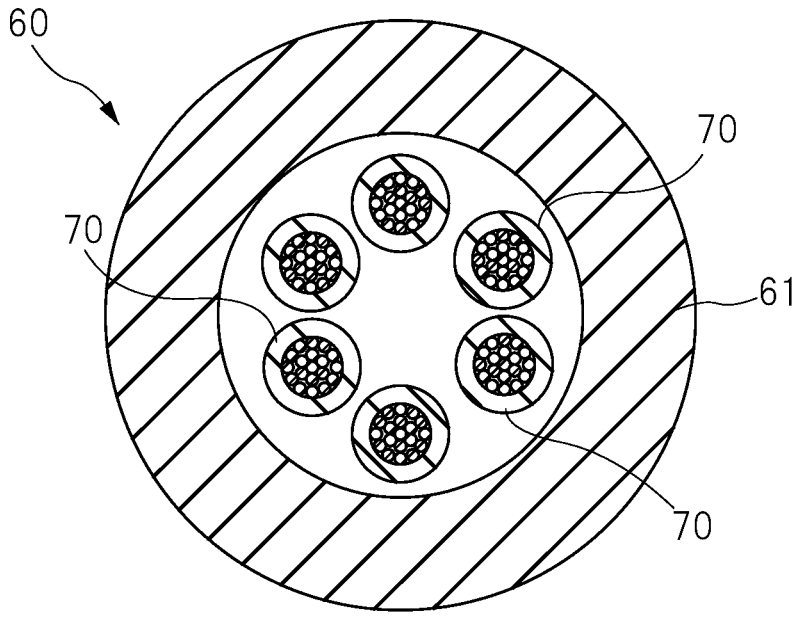
FIG. 3 is a cross-sectional view of a cable including the metallic wire shown in FIG. 1.
Figure 4:
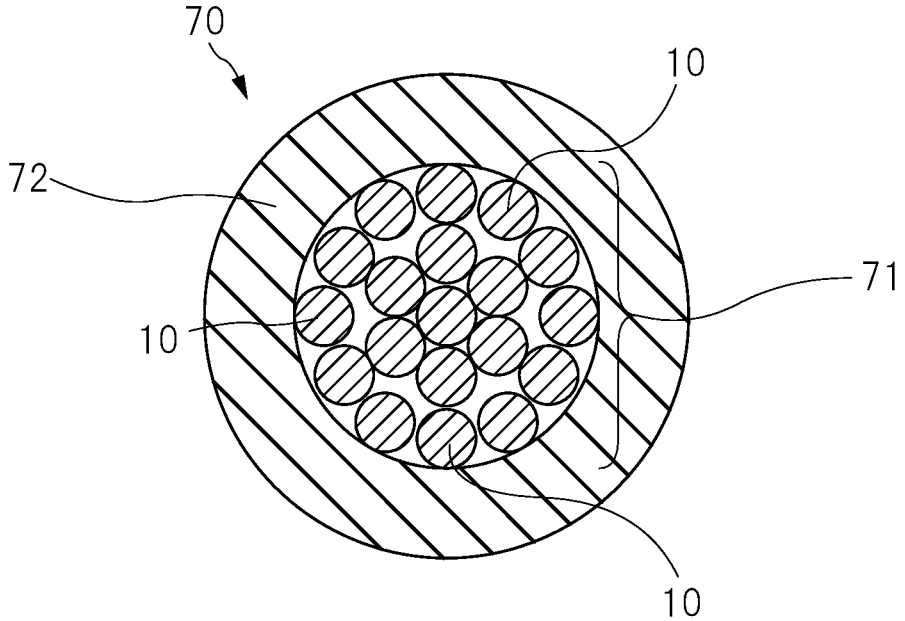
FIG. 4 is a cross-sectional view of one of a plurality of electrical wires included in the cable shown in FIG. 3.

Next, an application example of the copper alloy wire 10 shown in FIG. 1 will be explained. FIG. 3 is a cross-sectional view of a cable including the copper alloy wire 10 shown in FIG. 1. FIG. 4 is a cross-sectional view of one of a plurality of electrical wires included in the cable shown in FIG. 3.

A cable 60 shown in FIG. 3 includes a plurality of electrical wires (core wires) 70 and a collectively-coating sheath 61 on a periphery of the plurality of electrical wires 70. The cable 60 is a cable that is used in, for example, a mobile electronic device, an industrial robot or others. An outer diameter of the cable 60 is, for example, about 4.8 mm. The cable 60 includes the plurality of electrical wires 70, and each outer diameter of the plurality of electrical wires 70 is small. For example, in an example shown in FIGS. 3 and 4, the outer diameter of the electrical wire 70 is, for example, about 0.86 mm (860 μm).

As shown in FIG. 4, the electrical wire 70 includes: a center conductor 71 made of a plurality of copper alloy wires 10 to be a strand; and a coating insulator 72 on the center conductor 71. Each of the plurality of copper alloy wires 10 making up the center conductor 71 is made of the copper ally 11 explained with reference to FIG. 1. The copper alloy 11 making up this copper alloy wire 10 contains the indium, a content of which is equal to or more than 0.3 mass % and equal to or less than 0.45 mass %, and contains the tin, a total content of which with the indium is equal to or less than 0.45 mass %. Each wire diameter of the plurality of copper alloy wires 10 is, for example, 0.08 mm (80 μm).

In the manner, in the electrical wire 70 using the plurality of copper alloy wires 10 and the cable 60 using the electrical wire 70, the transmission property of the power supply or the electrical signal in the mobile electronic device can be improved. Alternatively, since the wire diameter can be decreased in the electrical wire 70 using many copper alloy wires 10 that are the extremely thin wires and the cable 60 using the electrical wire 70, an enclosure of the mobile electronic device, the industrial robot or others can be downsized.

Note that the electrical wire 70 is exemplified in FIG. 4. However, the electrical wire to which the copper alloy wire 10 shown in FIG. 1 have various modification examples. For example, the present invention is applicable to an electrical wire made of a conductor made of one copper alloy wire 10 and a coating insulator on a periphery of the conductor. In FIGS. 3 and 4, the plurality of copper ally wires 10 to be the strand is exemplified as the center conductor 71 of the electrical wire 70. However, the present invention is not limited to this, and the center conductor may be a center conductor 71 made of a plated wire described below.

<Plated Wire>

The plated wire is the one having a plating layer on a periphery (outer surface) of the copper alloy wire 10 shown in FIG. 1. The plated wire has a tensile strength that is equal to or higher than 750 MPa, an electrical conductivity that is equal to or higher than 78% IACS, and an elongation that is equal to or lower than 3%. That is, the plated wire having the plating layer on the periphery of the copper alloy wire 10 shown in FIG. 1 has the tensile strength that is equal to or higher than 750 MPa (more preferably equal to or higher than 750 MPa and equal to or lower than 900 MPa), the electrical conductivity that is equal to or higher than 78% IACS (more preferably equal to or higher than 78% IACS and equal to or lower than 85% IACS) and the elongation that is equal to or lower than 3% (more preferably equal to or higher than 0.5% and equal to or lower than 3%). Note that a plated wire 30 is a hard wire member.

As described above, the copper alloy wire 10 is made of the copper alloy containing the indium (In), a content of which is equal to or more than 0.3 mass % and equal to or less than 0.45 mass %. Particularly, the copper alloy wire 10 may be made of a copper alloy containing the indium (In), a content of which is equal to or more than 0.3 mass % and equal to or less than 0.45 mass %, and containing a remainder made of the copper (Cu) and the unavoidable impurities.

The plating layer is formed on the periphery of the copper alloy wire 10 so as to be in contact with the outer surface of the copper alloy wire. A thickness of the plating layer is, for example, equal to or larger than 0.1 μm and equal to or smaller than 1.5 μm. The plating layer is made of, for example, tin (Sn), silver (Ag), nickel (Ni) or others.

<Method of Manufacturing Plated Wire>

The plated wire is obtained by forming the plating layer on the copper alloy wire 10 that is obtained by the method of manufacturing the copper alloy wire 10 shown in FIG. 2. The copper alloy wire 10 obtained before the formation of the plating layer thereon is a metallic wire in a hard state having the tensile strength that is equal to or higher than 800 MPa and the electrical conductivity that is equal to or higher than 80% IACS. This copper alloy wire 10 is immersed in a plating bath in which a molten plating material (such as Sn) having a temperature (for example, that is equal to or higher than 250° C. and equal to or lower than 300° C.) is pooled. In the manner, the entire outer surface of the copper alloy wire 10 is coated with the hot-dip plating material. Then, this copper alloy wire 10 that is coated with the hot-dip plating material runs through a plating die to adjust a thickness of the hot-dip plating material on the surface of the copper alloy wire 10, so that a plating layer having a predetermined thickness is formed. Particularly, as conditions for coating the surface of the copper alloy wire 10 with the hot-dip plating material, immersion time in the hot-dip plating material is preferable to be equal to or longer than 0.1 second and equal to or shorter than 1.0 second at a line velocity that is equal to or higher than 100 m/min. The plated wire having the plating layer formed as described above remains in the hard state, and therefore, the elongation of the plated wire is equal to or higher than 0.5% and equal to or lower than 3.0%. Note that the copper alloy wire 10 may be thermally processed at a predetermined temperature (for example, equal to or higher than 300° C. and equal to or lower than 500° C.) before the surface of the copper alloy wire 10 is coated with the hot-dip plating material. The heating process time in the heating process on the copper alloy wire 10 is preferably set to be, for example, equal to or longer than 0.1 second and equal to or shorter than 1.0 second, so that the copper alloy wire 10 remaining in the hard state is immersed in the hot-dip plating material at the next step. This heating process may be performed in the same manufacture line as that of the step of forming the plating layer or a different manufacture line from that of the step of forming the plating layer.

<Property of Plated Wire>

Next, results of experiments of the properties of the plated wire will be explained. A table 2 is a table representing a relation between the properties of the plated wire and an alloy composition of the copper alloy wire making up the plated wire.

TABLE 2

| Specimen | Alloy Composition (mass %) | | Properties | | |
|---|---|---|---|---|---|
| | | | Tensile strength | Electrical conductivity | Elongation |
| No. | Sn | In | (MPa) | (% IACS) | (%) |
| 15 | 0.05 | 0.30 | 780 | 79.3 | 1.8 |
| 16 | 0 | 0.30 | 762 | 82.0 | 1.9 |
| 17 | 0 | 0.35 | 788 | 80.5 | 2.0 |
| 18 | 0.05 | 0.30 | 825 | 78.3 | 1.6 |
| 19 | 0 | 0.30 | 800 | 79.7 | 1.8 |
| 20 | 0 | 0.35 | 830 | 78.5 | 2.1 |

In the table 2, the specimens No. 15 to 20 represent working examples that meet the above-described conditions of the plated wire. Each of the specimens No. 15 to 20 is the one manufactured by forming the plating layer on the periphery of the copper alloy wire that is manufactured by the manufacturing method explained with reference to FIG. 2. More specifically, the copper alloy wire manufactured by the manufacturing method explained with reference to FIG. 2 was immersed in a plating bath in which a molten Sn (having a temperature that is equal to or higher than 250° C. and equal to or lower than 300° C.) was pooled, and then, the copper alloy wire coated with the hot-dip plating material run through a plating die to adjust a thickness of the hot-dip plating material coated on the surface of the copper alloy wire, so that a plating layer having a predetermined thickness was formed. In the table 2, a specimen used in the tensile strength test and the elongation test for the plated wire was obtained by forming the plating layer (having a thickness: about 0.5 μm) on the periphery of the copper alloy wire processed to have a diameter of about 80 μm (in the specimens No. 15 to 17) or a diameter of about 50 μm (in the specimens No. 18 to 20). Each of the copper alloy wire used for the specimens No. 15 to 20 was made of the copper alloy containing the indium (In) and the tin (Sn), a content of each of which is shown in the table 2, and containing the remainder made of the copper (Cu) and the unavoidable impurities. A tensile speed was set to 20 mm/min., and a gauge length in measurement of the elongation was set to 100 mm. The tensile strength is expressed by a value that is obtained by dividing a maximum load value at fracture by a cross-sectional area of each specimen. The cross-sectional area of each specimen is calculated as an area of an exact circle based on a wire diameter that is measured down to 1/1000 mm in a micrometer. A value of the elongation is expressed by a percentage of total elongation at fracture (a sum of elastic elongation and plastic elongation in the extensometer) with respect to a gauge length of an extensometer. Although omitted in the table 2, each of the specimens No. 15 to 20 was prepared under environment in which oxygen is difficult to be contained, and oxygen contained in the copper alloy wire of each specimen was equal to or less than 0.002 mass %.

As seen from a result of comparison among the specimens No. 15 to 20 in the table 2, when the content of the indium is equal to or more than 0.30 mass %, the tensile strength of the specimen can be equal to or higher than 750 MPa, and the electrical conductivity of the same can be equal to or higher than 78% IACS. Also, as seen from a result of comparison between the specimens No. 15 and 16 therein, even in a case with the addition of the tin as the additive element, the tensile strength of the specimen can be equal to or higher than 750 MPa, and the electrical conductivity of the same can be equal to or higher than 78% IACS as similar to the case without the addition of the tin. Note that the content of the indium contained in the copper alloy making up the copper alloy wire is preferably equal to or more than 0.30 mass % and equal to or less than 0.45 mass %. In a case with addition of the indium and the tin to the copper alloy making up the copper alloy wire, when the content of the tin is equal to or more than 0.02 mass % and less than 0.1 mass %, the tensile strength of the specimen can be equal to or higher than 750 MPa, and the electrical conductivity of the same can be equal to or higher than 78% IACS.

<Application Example of Plated Wire>

As described above, the plated wire is applicable as the center conductor making up the electrical wire or the cable. More specifically, the electrical wire is an electrical wire including the center conductor made of the plurality of plated wires to be a strand and the coating insulator on the center conductor. And, the cable may be a cable including a shield layer and a sheath that are formed on the periphery of this electrical wire.

The present invention is not limited to the foregoing embodiments and working examples, and can be variously modified within the scope of the present invention.

The foregoing embodiments include the following aspects.

[First Statement]

A method for manufacturing a copper alloy wire includes:

(a) a step of preparing a raw material containing copper and an additive element other than the copper;

(b) a step of forming a wire rod by melting, and then, casting the raw material;

(c) a step of forming a metallic wire by performing a drawing process to the wire rod;

(d) after the step (c), a step of performing a heating process to the metallic wire to which the drawing process has been performed; and (e) after the step (d), a step of elongating the metallic wire to which the heating process has been performed, by further performing the drawing process until the metallic wire has a thickness that is equal to or less than 0.1 mm, and the wire rod is made of a copper alloy containing indium, a content of which is equal to or more than 0.3 mass % and equal to or less than 0.45 mass %, and containing tin, a total content of which with the indium is equal to or less than 0.45 mass %.

[Second Statement]

In the method for manufacturing the copper alloy wire in the first statement, the copper alloy contains the tin, a content of which is equal to or more than 0.02 mass % and less than 0.1 mass %.

[Third Statement]

In the method for manufacturing the copper alloy wire in the first or second statement, in the step (d), when "C=B/A" is set as a ratio in a tensile strength in an assumption that a tensile strength of the metallic wire to which the drawing process has been performed after the step (c) is represented by "A" and a tensile strength of the metallic wire to which the heating process has been performed after the step (d) is represented by "B", the heating process is performed so that a value of the ratio "C" is equal to or higher than 0.5 and equal to or lower than 0.8, and, when "F=E/D" is set as a ratio in an elongation in an assumption that an elongation of the metallic wire to which the drawing process has been performed after the step (c) is represented by "D" and an elongation of the metallic wire to which the heating process has been performed after the step (d) is represented by "E", the heating process is performed so that a value of the ratio "F" is equal to or higher than 10 and equal to or lower than 50.

[Fourth Statement]

In the method for manufacturing the copper alloy wire in the third statement, in the step (d), the heating process is performed so that an electrical conductivity of the metallic wire obtained immediately after the heating process in the step (d) is equal to or higher than 86% IACS.

The present invention is usable to a copper alloy wire that is applicable to a conductor of a cable (such as an extremely-thin coaxial cable) for use in an internal wiring of a small electronic device (such as a digital camera, a surveillance camera, a personal computer and a smartphone) and a bending-resistant cable (such as an endoscope cable and a probe cable) for use in an industrial robot and a medical device (such as a gastroscope and an ultrasound diagnosis device).

What is claimed is:

1. A copper alloy wire made of a copper alloy, wherein the copper alloy contains indium, a content of which is equal to or more than 0.3 mass % and equal to or less than 0.45 mass %, the copper alloy does not contain more than 0.003 mass % phosphorous, the copper alloy does not contain more than 0.003 mass % silver, a tensile strength of the copper alloy wire is equal to or higher than 800 MPa, and an electrical conductivity of the copper alloy wire is equal to or higher than 80% IACS.

2. The copper alloy wire according to claim 1, wherein the copper alloy contains tin, a content of which is equal to or more than 0.02 mass % and less than 0.1 mass %, and a total content of the indium and the tin is equal to or less than 0.45 mass %.

3. An electrical wire comprising:

a conductor made of the copper alloy wire; and a coating insulator on a periphery of the conductor, wherein the copper alloy wire is made of a copper alloy containing indium, a content of which is equal to or more than 0.3 mass % and equal to or less than 0.45 mass %, the copper alloy does not contain more than 0.003 mass % phosphorus, the copper alloy does not contain more than 0.003 mass % silver, a tensile strength of the copper alloy wire is equal to or higher than 800 MPa, and an electrical conductivity of the copper alloy wire is equal to or higher than 80% IACS.

4. The electrical wire according to claim 3, wherein the copper alloy contains tin, a content of which is equal to or more than 0.02 mass % and less than 0.1 mass %, and a total content of the indium and the tin is equal to or less than 0.45 mass %.

5. The electrical wire according to claim 3, wherein the conductor is made of a strand of a plurality of the copper alloy wires.

6. A cable comprising:

a plurality of core wires each having a conductor made of a copper alloy wire and a coating insulator on a periphery of the conductor; and a collectively-coating sheath on a periphery of the plurality of core wires, wherein the copper alloy wire is made of a copper alloy containing indium, a content of which is equal to or more than 0.3 mass % and equal to or less than 0.45 mass %, the copper alloy does not contain more than 0.003 mass % phosphorus, the copper alloy does not contain more than 0.003 mass % silver, a tensile strength of the copper alloy wire is equal to or higher than 800 MPa, and an electrical conductivity of the copper alloy wire is equal to or higher than 80% IACS.

7. The cable according to claim 6, wherein the copper alloy contains tin, a content of which is equal to or more than 0.02 mass % and less than 0.1 mass %, and a total content of the indium and the tin is equal to or less than 0.45 mass %.

8. A plated wire comprising:

a copper alloy wire; and a plating layer that is arranged on a periphery of the copper alloy wire, wherein the copper alloy wire is made of a copper alloy containing indium, a content of which is equal to or more than 0.3 mass % and equal to or less than 0.45 mass %, the copper alloy does not contain more than 0.003 mass % phosphorous, the copper alloy does not contain more than 0.003 mass % silver, and a tensile strength of the copper alloy wire is equal to or higher than 750 MPa, an electrical conductivity of the copper alloy wire is equal to or higher than 78% IACS, and an elongation of the copper alloy wire is equal to or lower than 3%.

* * * * *